US006231438B1

(12) United States Patent
Laudermilk

(10) Patent No.: US 6,231,438 B1
(45) Date of Patent: May 15, 2001

(54) MANUALLY ADJUSTABLE UNDERFLOOR AIRFLOW DAMPER ASSEMBLY

(75) Inventor: Kenneth J. Laudermilk, Duluth, GA (US)

(73) Assignee: Gebruder Trox GmbH (DE)

( * ) Notice: Subject to any disclaimer, the term of this patent is extended or adjusted under 35 U.S.C. 154(b) by 0 days.

(21) Appl. No.: 09/553,347

(22) Filed: Apr. 21, 2000

(51) Int. Cl.[7] ..... F24F 7/00
(52) U.S. Cl. ..... 454/290
(58) Field of Search ..... 454/290, 289, 454/127, 136

(56) References Cited

U.S. PATENT DOCUMENTS 5,938,525 * 8/1999 Birdsong et al. ..... 454/290
6,016,976 * 1/2000 Kern et al. ..... 239/503
6,083,100 * 7/2000 Hardy et al. ..... 454/290

* cited by examiner

*Primary Examiner*—Harold Joyce
*Assistant Examiner*—Derek S. Boles
(74) *Attorney, Agent, or Firm*—William B Noll

(57) ABSTRACT

A floor mounted adjustable airflow assembly for use with an underfloor air distribution or diffuser system. The assembly comprises a circular grate housing nesting a rotatable and removable, circular grate mechanism, where the assembly includes a cam riding, continuous sleeve that may be recessed by rotation of the circular grate mechanism for full air flow, or extended to close off air flow, or readily set at selected positions therebetween as a means to control air flow from an underfloor plenum to the space above the floor.

10 Claims, 3 Drawing Sheets

MANUALLY ADJUSTABLE UNDERFLOOR AIRFLOW DAMPER ASSEMBLY

RELATED APPLICATION

This application represents an improvement to U.S. Ser. No. 09/246,052, filed Feb. 8, 1999, directed to an "Underfloor Air Diffuser Assembly", by one of the inventors thereof, where the contents of the copending application are incorporated herein by reference in their entirety.

FIELD OF THE INVENTION

This invention is directed to the field of underfloor air distribution systems, more particularly to a manually adjustable, underfloor airflow damper assembly, that may be simply rotated to effect a fully opened damper to a fully closed damper, or any degree therebetween.

BACKGROUND OF THE INVENTION

The present invention relates to an improved underfloor air diffuser or distribution system, such as for heating and air conditioning, more particularly the invention is directed to a manually adjustable and readily removable airflow damper assembly that is mounted in a floor opening, where underfloor plenums supply air, preferably under pressure, to the spaces above the floor. This system is in stark contrast to the traditional overhead ventilation systems that are not easily adapted to changes or reconfiguration of office space.

Most large office buildings constructed in the past ten years consist of individual offices, preferably along all of the building facade surrounding a large open interior office space. Interior offices are created using acoustical partitions and modular furniture, which may be easily relocated to reconfigure the office space in accordance with occupancy or process demands. The prominent detriment to reconfiguration is usually the relocation of electrical and mechanical services. Electrical services include power and communication transmission cables and their receptacles, while mechanical systems refer primarily to the air conditioning and ventilation systems.

Several construction methods have been developed to allow relocation of electrical services in the open office environment. All of these systems, as known in the art, depend on placement of the outlets within the floor plane.

The use of raised access floors in office space applications is rapidly gaining popularity. These systems allow power and communications wiring to be located in an easily accessible cavity below the office floor. In addition, the cavity may be used for the supply of conditioned air to the office space, eliminating most of the ductwork and insulation requirements that are inherent to overhead systems.

Underfloor air delivery systems are now becoming popular with the business community and developers due primarily to economics. Underfloor air systems, as presently known, deliver air to large zoning plenums via air terminals mounted in a floor cavity. Air is delivered to the occupants, such as employees, by means of high induction floor outlets that are tapped directly into the pressurized floor plenum.

The present invention differs from existing floor diffuser assemblies by the combination and use of adjustable components. The manner by which this combination is constructed, particularly the improved airflow damper assembly, and the many advantages to be gained thereby, will become apparent to those skilled in the art from the following description, particularly when read in conjunction with the accompanying drawings.

SUMMARY OF THE INVENTION

This invention is directed to the field of underfloor air diffuser systems for transmitting air, preferably under pressure, from a series of underfloor plenums through at least one floor opening to the space above the floor. Typically, the floor opening extends between an upper surface and a lower surface and includes a circular grate essentially flush with the upper surface. The improved features of the invention relate to a manually adjustable and easily removable damper assembly for controlling airflow from the plenums to the above floor space, from a fully opened position to a fully closed position, and positions therebetween. The airflow damper assembly comprises a circular grate housing having a cylindrical body portion with an outwardly extending flange portion to override the upper floor surface, with the body portion extending through the floor opening. The body portion is provided with a shoulder spaced internally below the flange portion to receive a rotatable and removable, circular grate mechanism, as later described. Additionally, the body portion includes a circular flange ring threadably engaging the body portion for fixedly securing the body portion to the floor, and plural cam riding pins projecting inwardly from the body portion. Cooperating with the body portion is a circular sleeve member containing angled cam slots, one for each cam riding pin, where the circular sleeve member is secured to the body portion by means of the cam riding pins to allow both rotative and vertical movement of the sleeve member relative to the body portion, and a pair of axially extending, spaced apart arms. The system also includes a manually rotatable and removable, circular grate mechanism sized to seat on the internal shoulder. The grate mechanism includes a series of concentric, spaced apart grate rings with openings to allow passage of air therethrough, and a peripheral portion to essentially lie contiguous with the interior of the body portion. Fixed to the underside of the grate rings are plural vane members to direct the passage of the air. Further, a downwardly extending axial arm is positioned to be slidably received between the spaced apart arms of the sleeve member. Finally, a dirt basket is suspended from the grate rings, and may be fixed at selected depths below the grate rings.

Accordingly, an object of this invention is to provide an improved underfloor air diffuser assembly by the use of a manually adjustable and easily removable airflow damper assembly.

A further object hereof is the provision of an airflow diffuser assembly that incorporates a circular sleeve member having plural, angled cam slots that facilitate both rotative and vertical movement of the assembly, thereby controlling the opening of the damper.

Another object of the invention lies in the use of a removable grate mechanism to effect easy removal of debris and dirt collected by the mechanism.

Still another object of this invention lies in the use of a rotatable grate mechanism, that includes indicia thereon to readily determine the extent to which the damper is open or closed.

These and other objects will become apparent from a reading of the following specification, when read in conjunction with the accompanying drawings, particularly by those skilled in the art.

DETAILED DESCRIPTION OF PREFERRED EMBODIMENT

Figure 1:
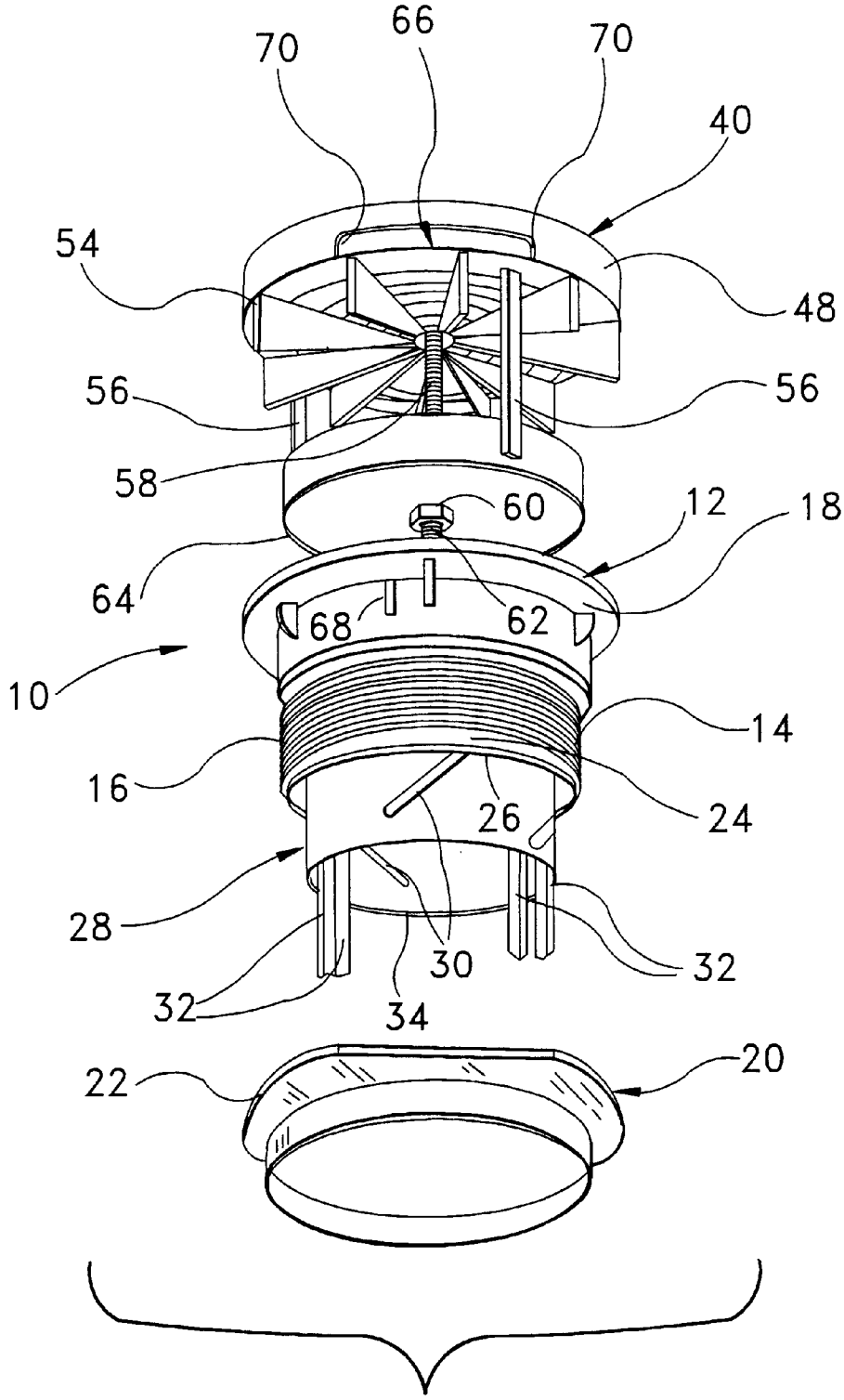
FIG. 1 is an exploded perspective view of the manually adjustable, underfloor, airflow damper assembly of this invention, where said assembly may be used in an underfloor air distribution system.
Figure 2:
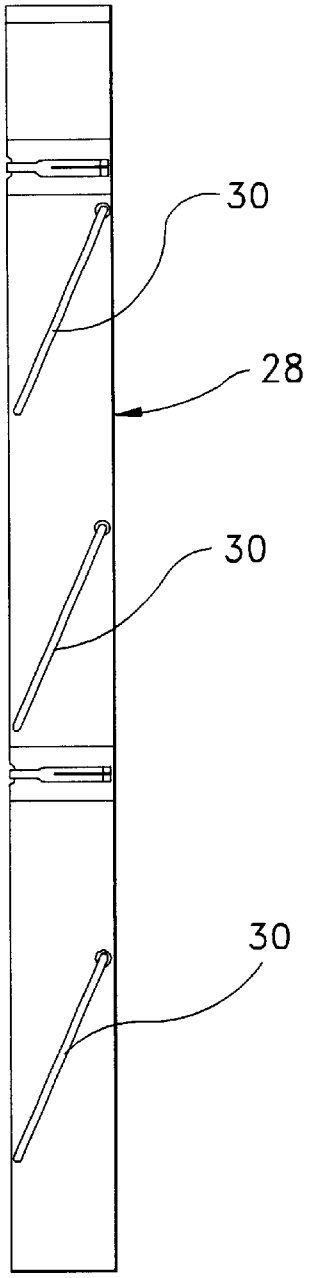
FIG. 2 is an enlarged side view of the vertically movable sleeve mechanism, forming a part of the assembly of FIG. 1, where said sleeve is shown as having a discrete length prior to forming into a continuous, cylindrical member.

This invention is directed to an improved underfloor air distribution or diffuser system that incorporates a manually adjustable and removable airflow damper assembly that is mounted in a floor opening in communication with the air distribution plenums under the floor. Such a system offers distinct advantages over a traditional air ventilation system that is often limited in its flexibility in ventilating interior spaces.

Underfloor air distribution systems have become a new office design technique because it overcomes the limitations of traditional overhead systems. By way of background, a brief look at an underfloor or access floor system may be helpful in further understanding this invention.

A raised access floor system consists of a rigid structural grid that supports lay-in floor panels. These floor panels are typically 1 to 1½ inches thick and constructed of reinforced steel or concrete-like material. They are supported such that the resultant floor level is usually 8 to 12 inches above the actual slab. This creates a cavity in which all power supply, data, and communication cables may be located. These cables are routed via modular connections to floor or system furniture panel outlet boxes. Space changes can be easily accomplished by simply relocating floor panels and adding or deleting modular sections of cable. Floor air diffusers may be ducted but are typically mounted directly into the floor panels and supply conditioned air directly from the pressurized floor plenum or cavity to the space. This allows the diffusers to be easily moved as well by simply relocating the floor panel in which they are mounted.

The invention hereof is directed primarily to an improved airflow damper assembly, as illustrated in the several Figures, where like reference numerals represent like components or features throughout the various views.

Figure 4:
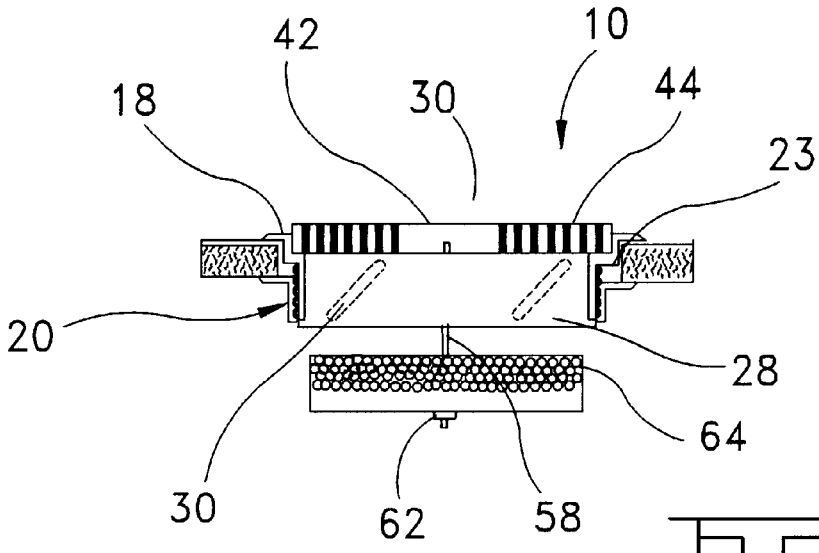
FIG. 4 is a sectional view, with certain hidden parts shown in phantom, of the assembled airflow damper assembly in the fully opened position.
Figure 5:
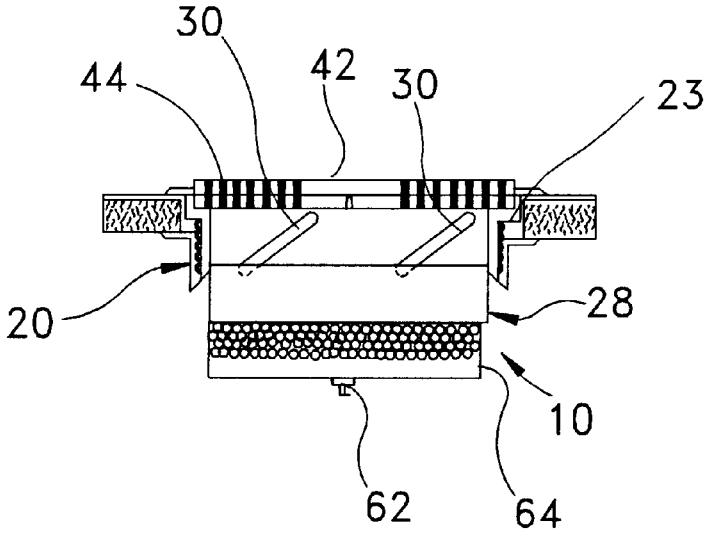
FIG. 5 is a sectional view, similar to FIG. 4, showing the assembled airflow damper assembly in the fully closed position.

Turning now FIG. 1, which illustrates the improved airflow damper assembly 10 in an exploded manner, the assembly 10 comprises a circular grate housing 12 having a cylindrical body portion 14, externally threaded 16 along the lower portion, and features an outwardly directed flange 18 to allow positioning of the circular grate housing 12 in a floor opening in communication with the underfloor plenums, as known in the art. Threadably engaging the lower portion of the grate housing, and cooperating therewith, is a flange ring 20, including an outwardly extending rim 22. In operation, the flange ring 20 threadably engages the threads 16 to bring the rim 22 into contact with the lower surface of a floor, adjacent a floor opening, to thereby fix the circular grate housing 12 relative to the floor, see FIGS. 4 and 5. Additionally, internally the cylindrical body includes a shoulder 23 spaced below the flange 18, the purpose of which will be discussed later.

Figure 3:
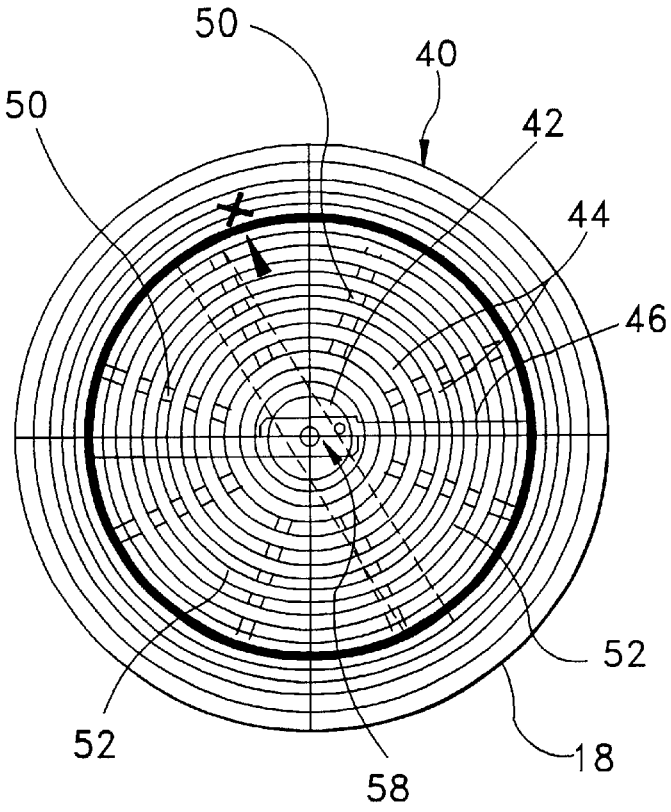
FIG. 3 is a top view of the floor mounted assembly of this invention, illustrating indicia on the grate surface to identify opened and closed positions therefore.

A feature of the grate housing 12 is the provision of plural cam riding pins 24 projecting inwardly of the body portion 14 in close proximity to the continuous lower edge 26. Secured for simultaneous rotative and vertical movement relative to said pins 24 is a continuous cylindrical sleeve 28 having a like plurality of angled cam slots 30, one slot for each said pin 24. FIG. 3 illustrates said sleeve 28 as a discrete length member prior to its formation into a continuous sleeve. Another feature of the sleeve 28 are two pairs of axially directed, spaced apart arms 32, preferably about 180° apart, extending below the lower sleeve edge 34, the function of which will become clearer hereafter.

The final component forming a part of the airflow damper assembly 10 is the circular grate mechanism 40, as best seen in FIGS. 1 and 3. The grate mechanism 40 comprises an upper portion consisting of a solid center portion 42 surrounded by plural concentric grate rings 44 and terminating in an outer peripheral ring 46, where said peripheral ring features a peripheral surface 48 sized to seat within the body portion 14 on shoulder 23. The respective grate rings 44, 46 are spaced apart by web section 50 to define plural arcuate openings 52 to allow the passage of air therethrough. On the underside of the grate rings 44, 46 are mounted a series of radially directed, angled vanes 54 which act to effect a swirling action of the air as it passes thereby.

Extending downwardly from said underside are a pair of arms 56 laterally sized to be slidably received between the pairs of spaced apart arms 32. This arrangement temporarily fixes the relative relationship between the sleeve 28 and the grate mechanism 40. Thus, by rotating the grate mechanism, as later described, the sleeve 28 also rotates but simultaneously rides up or down, depending on the direction of rotation, by virtue of the angled cam slots 30 riding along the pins 24. Further, centrally disposed and extending downwardly from the underside of center portion 42 is a threaded rod 58 mounting at its distal end 60, by threaded nut 62, a dirt basket 64, where the dirt basket 64 may be selectively fixed at varying depths along the rod 58. Actually, the pair of arms 56 may consist of a single U-shaped member with the free legs thereof defining the arms, and the connecting base element secured to the underside of center portion 42. In such a configuration, the rod 58 may be fixed to this base element. To define the rotative extent of the grate mechanism 40, the peripheral surface 48 may include an arcuate recess 66, preferably about 60 degrees, which cooperates with a projection 68, shown in dotted lines in FIG. 1, to limit said rotation.

In operation, the circular grate mechanism is lowered into the grate housing where the grate housing rests on the shoulder 23. In this position the upper surface of the grate mechanism is essentially flush with the annular rim or flange 18 and surrounding carpeting or other floor covering. To set the damper opening, the integral grate rings are manually rotated to a selected position between the indicia marks, see FIG. 3, which may for convenience be "−" for the fully closed position, or a "+" for the fully opened position, see further FIGS. 4 and 5, respectively showing the assembly hereof in the fully opened position and fully closed position. These extreme positions coincide with the projection 68 contacting the ends 70 of arcuate slot 66. For example, as noted in FIG. 5, the sleeve 28 is shown in its lowermost position blocking the normal open space between the dirt basket 64 and the lower edge of body portion 14. This in effect closes off any air from the underfloor plenums. As the sleeve 28 is caused to rise, see FIG. 4, an opening is provided for such plenum air. Also, if one desires to perform maintenance and/or clean debris from the dirt basket, one may easily lift the grate mechanism from the grate housing to accomplish the desired task without disturbing any of the settings. While the mechanism is free of the housing, one can also change the depth of the dirt basket by merely raising the dirt basket and tightening the threaded nut 62.

It is recognized that modifications, changes and additions may be made to the components of the underfloor airflow damper assembly of this invention, such as in the selection of materials. Typically, since the respective components are exposed to conditioned air, and through the various floor locations where conditioned air is required, preferred classes of materials are those which exhibit a corrosion resistant quality, such as brass, aluminum and plastics. However, other materials may also be suitable. Accordingly, no limitation is intended to be imposed on this invention, except as set forth in the following claims.

What is claimed is:

1. In an underfloor air diffuser system for transmitting air from a series of underfloor plenums through at least one floor opening to the space above the floor, where said floor opening extends between an upper surface and a lower surface and includes a circular grate essentially flush with said upper surface, the improvement comprising in combination therewith the provision of a manually adjustable airflow damper assembly for controlling airflow from said plenums to said space from a fully opened position to a fully closed position, said airflow damper assembly comprising:

a) a circular grate housing having a cylindrical body portion with an outwardly extending flange portion to override said upper surface, where said body portion extends through a said floor opening, a shoulder spaced internally below said flange portion, a circular flange member threadably engaging said body portion for fixedly securing said body portion to said floor, and plural cam riding pins projecting inwardly from said body portion;

b) a circular sleeve member having a continuous upper edge and a continuous lower edge, plural angled cam slots extending in close proximity from said upper edge to close proximity to said lower edge, one said slot for each said cam riding pins, where said circular sleeve member is fixed to said body portion by means of said cam riding pins to allow both rotative and vertical movement of said sleeve member relative to said body portion, and a pair of axially extending, spaced apart arms; and c) a manually rotatable, circular grate mechanism sized to seat on said internal shoulder, said grate mechanism including a series of concentric, spaced apart grate rings with openings to allow passage of air therethrough, a peripheral portion to essentially lie contiguous with the interior of said body portion, plural fixed vane members to direct the passage of said air, a suspended dirt basket, and a downwardly extending axial arm positioned to be slidably received between said spaced apart arms.

2. The underfloor air diffuser system according to claim 1, wherein said plural vane members are fixed to the underside of said grate rings.

3. The underfloor air diffuser system according to claim 2, wherein said dirt basket is suspended from the underside of said grate rings.

4. The underfloor air diffuser system according to claim 1, wherein said shoulder includes an inwardly directed projection, and said peripheral portion includes an arcuate slot within which said projection rides, whereby the respective ends of said arcuate slot represent said fully opened position and said fully closed position.

5. The underfloor air diffuser system according to claim 4, wherein said arcuate slot is about 60°.

6. The underfloor air diffuser system according to claim 5, wherein said grate rings include indicia to visually indicate the damper opening position, as the said circular grate mechanism is rotated between said respective slot ends.

7. In an underfloor air diffuser system for transmitting air from a series of underfloor plenums through at least one floor opening to the space above the floor, where said floor opening extends between an upper surface and a lower surface and includes a circular grate essentially flush with said upper surface, the improvement comprising in combination therewith the provision of a manually adjustable airflow damper assembly for controlling airflow from said plenums to said space from a fully opened position to a fully closed position, said damper assembly comprising:

a) a circular grate housing having a cylindrical body portion with an outwardly extending flange portion to override said upper surface, where said body portion extends through a said floor opening, a shoulder spaced internally below said flange portion, a circular flange member threadably engaging said body portion for fixedly securing said body portion to said floor, and plural cam riding pins projecting inwardly from said body portion;

b) a circular sleeve member having a continuous upper edge and a continuous lower edge, plural angled cam slots, one said slot for each said cam riding oins, where said circular sleeve member is fixed for sliding movement to said body portion by means of aid cam riding pins to allow both rotative and vertical movement of said sleeve member relative to said body portion;

c) a manually rotatable, circular grate mechanism sized to seat on said internal shoulder, said grate mechanism including a series of concentric, spaced apart grate rings with openings to allow passage of air therethrough, a peripheral portion to essentially lie contiguous with the interior of said body portion, plural fixed vane members to direct the passage of said air, and a suspended dirt basket; and, d) means cooperating between said circular grate mechanism and said circular sleeve to effect rotative and vertical movement of said circular sleeve upon rotation of said grate mechanism.

8. The underfloor air diffuser system according to claim 7, wherein said plural vane members are fixed to the underside of said grate rings.

9. The underfloor air diffuser system according to claim 8, wherein said dirt basket is suspended from the underside of said grate rings.

10. The underfloor air diffuser system according to claim 7, wherein said shoulder includes an inwardly directed projection, and said peripheral portion includes an arcuate recess within which said projection rides, whereby the respective ends of said arcuate recess represent said fully opened position and said fully closed position.

* * * * *